United States Patent [19]

Joelson

[11] 4,324,220

[45] Apr. 13, 1982

[54] SLINGSHOT-LIKE TETHER TOY

[76] Inventor: Ronald Joelson, R.R. 1, Chetek, Wis. 54728

[21] Appl. No.: 22,217

[22] Filed: Mar. 19, 1979

Related U.S. Application Data

[63] Continuation-in-part of Ser. No. 926,739, Jul. 21, 1978, abandoned.

[51] Int. Cl.[3] ..... F41B 7/00

[52] U.S. Cl. ..... 124/18

[58] Field of Search ..... 124/5, 4, 17, 18, 20 R, 124/93; 273/95 A, 98, 335, 58 C; 46/77

[56] References Cited

U.S. PATENT DOCUMENTS

| | | | |
|---|---|---|---|
| 1,022,339 | 4/1912 | Sloan | 273/95 A |
| 2,081,059 | 5/1937 | Mitchell | 273/58 C X |
| 3,376,037 | 4/1968 | Lepselter | 273/95 A X |
| 3,652,088 | 3/1972 | Marsh | 273/DIG. 8 X |
| 3,804,409 | 4/1974 | Schachner | 273/95 A X |

FOREIGN PATENT DOCUMENTS

| | | | |
|---|---|---|---|
| 32359 | 9/1923 | Denmark | 124/18 |
| Ad.10936 | of 1892 | United Kingdom | 124/18 |
| Ad.29748 | of 1897 | United Kingdom | 124/17 |

*Primary Examiner*—Richard C. Pinkham
*Assistant Examiner*—William R. Browne
*Attorney, Agent, or Firm*—Berman, Aisenberg & Platt

[57] ABSTRACT

A slingshot-like tether toy which includes a handle and a ball which are connected by a single elastic cord having a stop formed or fastened between the handle and the ball. The elastic cord is adapted to pass into a slot in one edge of the handle with the stop engaging a handle surface adjacent the slot to tension a portion of the cord as the ball is drawn back prior to release. Upon release, the stop disengages the handle, and the ball continues its travel towards the target. The entire elastic cord acts as a tether to return the ball to the user.

9 Claims, 9 Drawing Figures

FIG. 1.
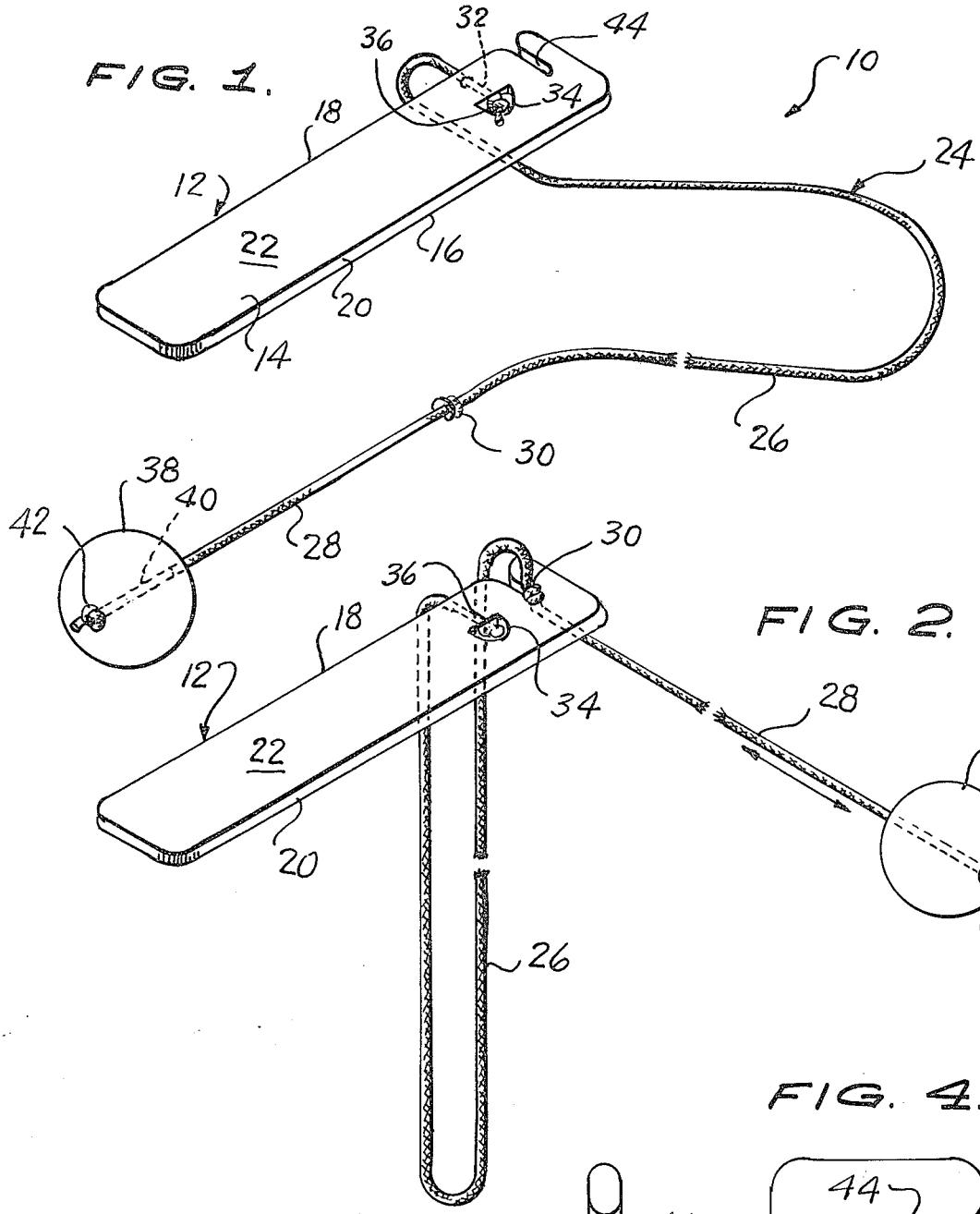
FIG. 2.
FIG. 3.
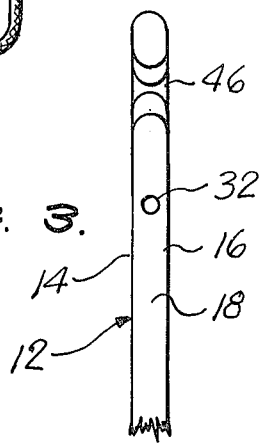
FIG. 4.
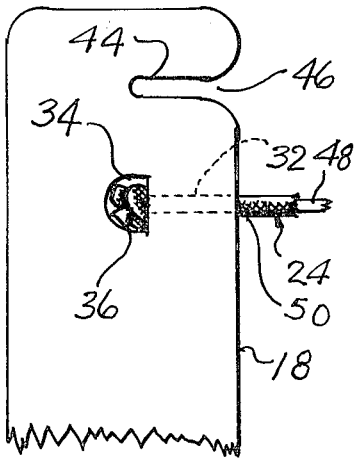

FIG. 5
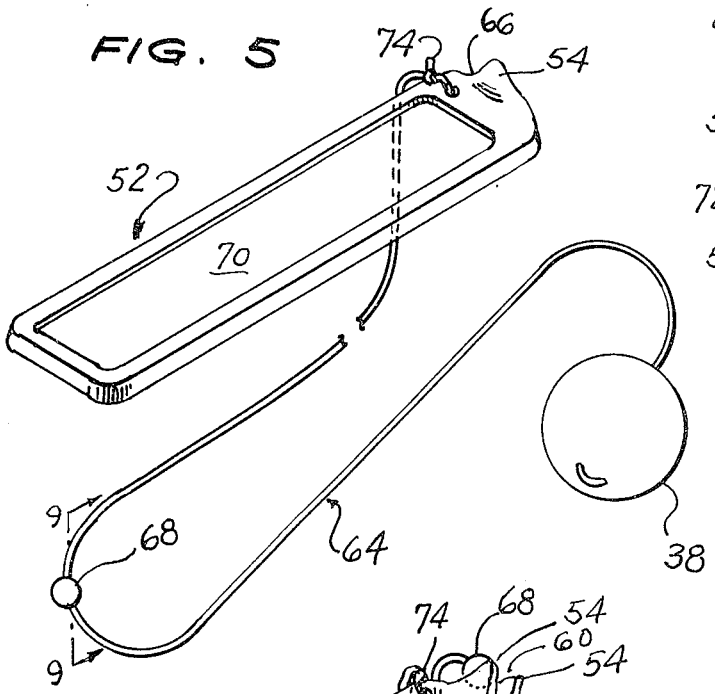
FIG. 6.
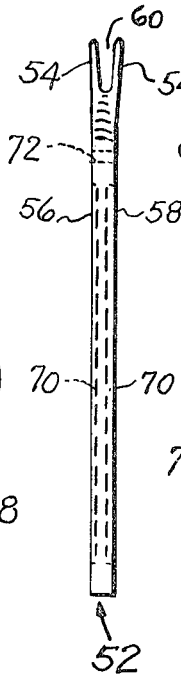
FIG. 7.
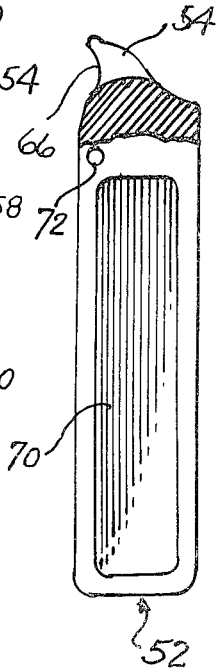
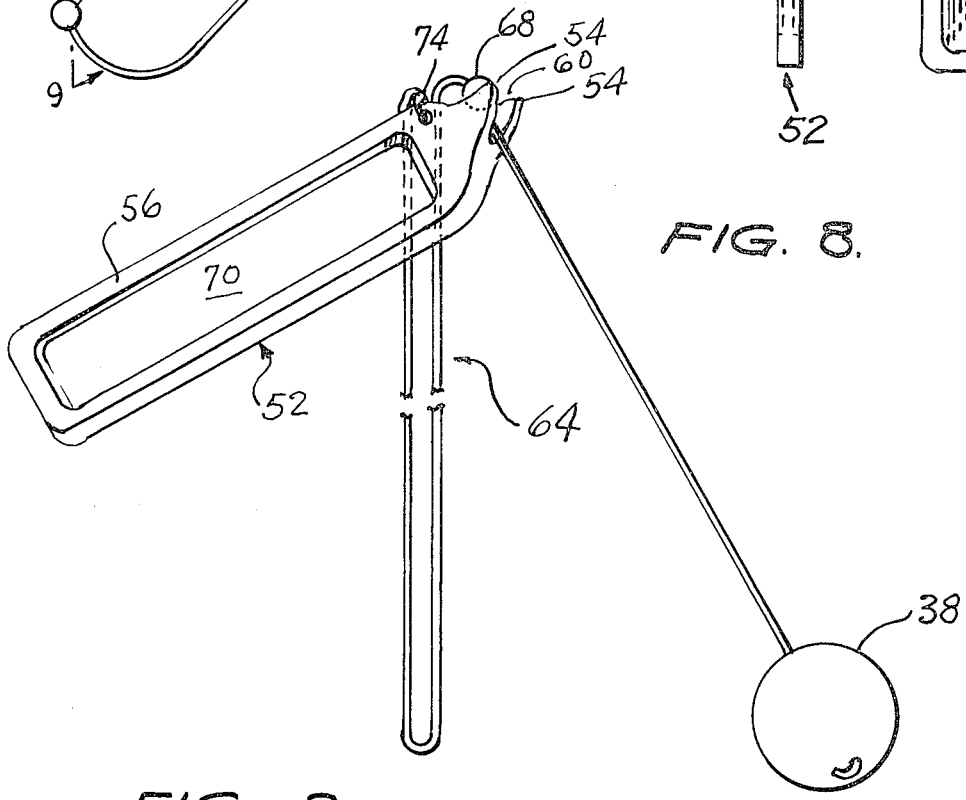
FIG. 8.
FIG. 9.
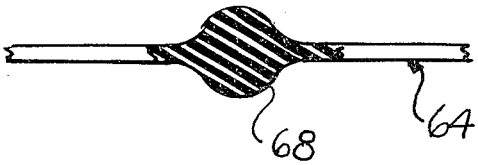

SLINGSHOT-LIKE TETHER TOY

This application is a continuation in part of my co-pending application Ser. No. 926,739, filed July 21, 1978 now abandoned.

BACKGROUND OF THE INVENTION

1. Field of the Invention

The present invention is related to toys and, more particularly, is directed towards a slingshot-like tether toy for children.

2. Description of the Prior Art

Slingshots have long been popular, especially with children. The notion of being able to aim at a target and release a moving projectile ("ammunition") is believed to be particularly appealing. Unfortunately, ordinary slingshots can be extremely dangerous, and therefore cannot be classified as toys which are safe for use by children. The danger being that it is impossible to control the size, weight, shape or velocity of the projectile that is to be "fired" by the slingshot. Further, such projectiles or "ammunition" are usually irretrievable after having been fired.

In my co-pending application, Ser. No. 926,739, referred to above, is disclosed a toy which provides a slingshot-like action, and yet which is completely safe for use by children, overcoming the defects and disadvantages of the prior art devices briefly outlined above.

OBJECTS AND SUMMARY OF THE INVENTION

The present invention is an improvement over that disclosed in my co-pending application referred to above, and differs structurally from the same in the following respects:

A single elastic cord is used as a tether connecting the ball missle to the handle, instead of two separate strands or cords, one formed as a loop, and tied together.

A stop means is formed in or added to the tether cord intermediate its ends and functions to enable stretching of a portion of the cord for firing the ball thus providing a simple structure and avoiding the need to engage a cord loop over a separate hook added to or formed on the handle.

The elastic cord comprises a rubber band surrounded by one or more sleeves of stretch-woven fibers. The sleeves limit the amount of stretch which can be applied to the cord and thus control and regulate the trajectory of the ball when propelled.

The means for fastening the tether cord to the handle is also simplified by elimination of staples or other parts added to the handle.

From the above, it will be apparent that the primary objects of the present invention are to provide an improved slingshot-like toy having all of the advantages of the invention disclosed in my co-pending application, but which is of simplier construction, easier to make and assemble, easier to use, of better appearance, and less costly.

The foregoing and other objects are attained in accordance with one aspect of the present invention through the provision of a toy which comprises a handle, ball means, a single elastic cord tether connecting the handle to the ball means, stop means positioned along the elastic cord between the handle and the ball means, and stop positioning means on the handle which is adapted to be engaged by the stop means.

In a preferred embodiment, the handle is connected to a projectile ball by a single elastic cord having a stop means formed in the cord intermediate its ends. The stop means cooperates with a slot in the edge of the handle whose edges engage and position the stop means to enable elongation and tensioning of that portion of the elastic cord between the stop means and the ball. Upon release of the ball, the tension in the cord projects the ball toward a target and the ball is returned by the entire tether cord. It is preferred that the elastic cord comprise a rubber band surrounded by one or more layers of stretch-woven fiber threads so that when the cord is stretched the elongation is limited by the maximum stretch of the woven layers of threads. This yields a controlled trajectory of the ball, and since the weave-wrapped cord is stiffer, it is easier to handle and neater in appearance.

In accordance with another aspect of the present invention, the elastic cord may comprise a single length of rubber band having a globular stop member molded therein intermediate its ends, or otherwise integrally formed thereon. Alternatively, a separate stop member may be affixed to the cord, but in the preferred embodiment the stop means comprises merely a knot tied in the elastic cord formed of rubber surrounded by layers of woven material.

In accordance with other aspects of the present invention, the handle may consist of an elongated handle member having a pair of opposed side walls with tabs extended from one end. The two tabs are spaced so the slot forming the stop positioning means lies between the tabs. In this version, preferably the stop means is a ball, and the tabs at one side are concavely curved to form a seat in which the ball engages.

In accordance with yet another aspect of the present invention, the handle comprises an elongated handle member having a pair of opposed side wall surfaces and a pair of opposed edge wall surfaces connecting the side wall surfaces, and one end of the elastic cord is passed through a blind bore in one of said edge surfaces which intersects a hole extending between the side wall surfaces. To fasten the tether to the handle, the said one end is knotted and the knot is seated in said hole.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which:

FIG. 1 is a perspective view of a first preferred embodiment of the present invention;

FIG. 2 is a similar perspective view of the embodiment of FIG. 1, but with the stop means engaged in the stop positioning means ready for tensioning part of the elastic cord to fire the ball at a target;

FIG. 3 is a fragmentary side elevation showing one end of the handle;

FIG. 4 is a top plan view of that portion of the handle shown in FIG. 3;

FIG. 5 is a perspective view similar to FIG. 1, but showing a second preferred embodiment of the present invention;

FIG. 6 is a side view of the end portion of the handle member illustrated in FIG. 5;

FIG. 7 is a top plan view, partly in section, of the handle member portion shown in FIG. 6;

FIG. 8 is a perspective view, similar to FIG. 2, but showing the stop means of the second preferred embodiment engaged with the handle stop positioning means placing the toy in condition for use in firing the ball; and FIG. 9 is a fragmentary sectional view of the stop means formed in the elastic cord, taken along line 9—9 of FIG. 5.

DETAILED DESCRIPTION OF THE PREFERRED EMBODIMENTS

Referring now to the drawings, wherein like reference numerals represent identical or corresponding parts throughout the several views, and more particularly, to FIGS. 1-4 thereof, reference numeral 10 indicates generally, a first preferred embodiment of a slingshot-like tether toy of the present invention.

The toy 10 of the present invention comprises an elongated handle 12 which may be formed of any suitable material such as wood, plastic or the like. The handle 12 includes opposed top and bottom surfaces 14 and 16, respectively, and opposed edge surfaces 18 and 20, respectively. Reference numeral 22 in FIGS. 1 and 2 generally connotes a hand grip area. Area 22 may be contoured to any desired shape and may, for example, include finger grips or recesses for facilitating gripping the toy.

The toy of the present invention further comprises an elongated elastic cord 24 which is a single strand or length divided into two portions 26 and 28 by a stop means 30. Elastic cord 24 has one end secured to the handle 12 by any suitable means. A preferred means constitutes threading the end into a blind bore 32 in edge 18 of handle 12 which intersects an opening 34 between handle surfaces 14 and 16. The cord end is then knotted at 36 and the knot is pulled back to seat wholly within opening 34.

The other end of the elastic cord 24 is fastened to a ball 38 which may be formed of any suitable material, such as resilient rubber or soft polyurethane plastic. Clearly, the projectile 38 of the present invention is not restricted to the provision of a ball. Other objects of various shapes and sizes could be utilized such as resilient dart-shaped object, or the like. A ball 38 is, however, the best mode presently contemplated for carrying out the invention, and may be secured to the end of cord 24 by any suitable technique, such as that illustrated, which comprises threading the cord end through a diametrical hole 40 in the ball and then forming a knot 42 in the end of the cord.

A primary difference between the structure of the present invention and that of my co-pending application Ser. No. 926,739 is that elastic cord 24 is formed of a single, integral length of material rather than of two lengths, one of which is looped and tied to the other. In the present invention the knot 30, separating parts 26 and 28 of the cord, forms a stop means which engages the edges of slot 44 formed in edge 18 of the handle near one end. The slot 44, together with its edges and adjacent portions of handle surface 14 form a stop positioning means on the handle which by engagement with the knot 30 prevents further movement of the cord through the slot 44, and enables the cord portion 28 to be stretched and tensioned to provide the propelling force for ball 38. The inner end of the slot narrows to a width slightly wider than the cord diameter. The mouth 46 of slot 44 is widened and curved, as best seen in FIG. 4, to prevent undue wear or cutting of the cord.

A further important difference in the present invention over the former one, is that the single length of cord 24 is preferably formed of a band of rubber 38 or other suitable elastic material, surrounded by one or more layers, or sleeves 50, of cotton or rayon threads woven around the band with a stretch-weave. The stretch-woven sleeve limits the amount of stretch which can be applied to the inner rubber cord, or band, and regulates the flight of the projectile ball toward its target both as to distance and trajectory. The return of the ball to the user is also controlled better. The band with sleeve is stronger than a rubber band alone. It does not twiest as much and is easier to attach to the ball and handle, being somewhat stiffer than a rubber band alone.

Referring now to FIGS. 5 through 9, there is illustrated a second preferred embodiment of the present invention. Reference numeral 52 indicates a molded plastic handle having integrally formed tabs or ears 54,54 which protrude from one end of the handle in prolongation of the opposite faces 56, 58. Between tabs 54,54 is formed the slot 60 wide enough to pass the elastic cord 64. The outer edges of tabs 54 are each concavely curved as at 66 to seat stop means 68 as evident in FIG. 8. Thus, the tabs 54,54 defining slot 60 and seat 66, together form a stop positioning means on the handle for cooperating with the ball stop 68 on the elastic cord 64. To save material and weight, a large recess or cavity 70 is formed in each face 56 and 58 of the handle.

The elastic cord 64 is in this embodiment a single length of rubber band in which is integrally molded the; stop means 68 formed as a globular or spherical enlargement see FIG. 9. One end of the rubber cord is passed through the ball 38 and tied, as in the previous embodiment. The other end of the cord is passed through a hole 72 between the faces 56, 58 of the handle near tabs 54,54 and tied at 74. As in the previous embodiment, the stop means divides the elastic cord into two parts enabling stretching of one part to fire the ball toward a target.

FIGS. 2 and 8 are helpful in understanding operation and manner of using both described embodiments of the present invention. Initially, the handle 12 is preferably gripped in area 22 and held in a horizontal position with the top surface 14 facing away from the user. The mode of utilization hereafter described will assume the user is right-handed, it being understood that the present invention will work equally well for a left-handed person.

The outer portion of elastic cord 24 is placed in slot 44 and the user, having gripped the handle with his left hand, draws back on ball 38 with his right hand until the stop means 30 engages the stop positioning means of the handle. At this point, cord portion 28 is relatively taut, but portion 26 is not under any tension. The ball 38 is then pulled back further to stretch the outer portion 28 of the tether to the desired or maximum extent, so as to impart desired propelling force to the ball.

After the ball 38 is released, it will pass under handle 12 and the stop means becomes disengaged from the slot 44. The ball 38 will continue to travel toward the target until both portions of the elastic cord are pulled taut, or the ball strikes the target. The entire elastic cord then acts as a tether to return the ball 38 to the user.

The embodiment of FIG. 8 operates and is used in the same way, except that the handle is turned and held with its surface 56 facing upwardly and the seat portion 66 of tabs 54, facing away from the user.

The elastic cords 24 and 64 when fully stretched, extend over a length of about 8 to 10 feet. Clearly, different sizes, lengths, strengths and weight of elastic cords and balls 38 may be utilized within the teachings of the present invention. It is also obvious that integral stop means 68, FIG. 9, may be replaced by a separate metal ball, or other shaped part, having a slot to receive the cord and which is then crimped to fasten the part to the cord.

Obviously, numerous modifications and variations of the present invention are possible in light of the above teachings. It is therefore, to be understood within the scope of the appended claims, the invention may be practiced otherwise than as specifically described herein.

I claim as my invention:

1. A toy which comprises:

an elongated handle means for anchoring an elastic cord adapted to be held by one hand;

a projectile means for impacting a target;

a single elastic cord connecting said handle to said projectile means, said elastic cord projecting said projectile means in a path substantially nonparallel to the longitudinal axis of said handle means;

a stop positioning means located on said handle means;

a stop means positioned along said elastic cord between said handle and said projectile means to catch said elastic cord in said stop positioning means, said stop means adapted to be engaged by said stop positioning means;

said elastic cord comprises a rubber band; and wherein said stop means is a rubber ball integrally formed on said rubber band.

2. A toy as set forth in claim 1, wherein said elastic cord comprises at least one layer of textile threads woven about said rubber cord with a stretch weave.

3. A toy which comprises:

a handle;

a projectile means for impacting a target;

a single elastic cord connecting said handle to said projectile means, said elastic cord projecting said projectile means in a path substantially nonparallel to the longitudinal axis of said handle means;

a stop positioning means located on said handle and adapted to engage a stop means;

a stop means positioned along said elastic cord between said handle and said projectile means to catch said elastic cord by engaging said stop positioning means, wherein said handle comprises an elongated handle member having a pair of opposed side surfaces and a pair of edge surfaces connecting said side surfaces, a slot forming said stop positioning means passing through said handle member from one side surface to the other at one end of said handle member and intersecting one edge surface, there being a blind bore in said handle member through one edge, and a hole passing through said handle member intersecting said bore, said elastic cord being connected to said handle member by a passage at one of its ends into the bore which end is knotted and the knot being seated in said hole.

4. A toy which comprises:

a handle comprising an elongated handle member having a pair of opposed side walls;

a slot being formed between a pair of ears extending from said side walls at one end of said handle member;

a projectile;

a single elastic cord having one end connected to said handle and having the other end connected to said projectile;

stop means positioned along said elastic cord between said handle and said projectile;

stop positioning means for engaging said stop means and comprising said slot located on said handle, wherein said slot passes said elastic cord until said stop means engages the edges of said slot.

5. A toy as set forth in claim 4, wherein said stop means is a ball and said ears are each concavely curved to form a seat for said ball.

6. The toy of claim 5 wherein said ears are convex on a surface opposite said seat.

7. A toy which comprises:

a handle member comprising an elongated handle member having a pair of opposed side walls, said handle member having a slot passing through said side walls near one end of said handle member, a projectile;

a single elastic cord connecting said handle to said projectile;

stop means positioned along said elastic cord between said handle and said projectile for engaging said slot;

stop positioning means comprising said slot located on said handle and adapted to be engaged by said stop means;

wherein said slot is adapted to pass said elastic cord until said stop means engages one of said side walls of said handle member.

8. A toy as set forth in claim 7, wherein said slot is wide and rounded at its mouth in the edge of the handle member and narrows inwardly away from its mouth to a neck slightly larger than the width of the elastic cord so that the edges of the slot engage the stop means.

9. A toy comprising:

an elongate member having a pair of opposed side walls, a pair of ears at one end of said elongate member, each ear of said pair of ears extending from one of said pair of side walls, said ears forming a slot therebetween, each of said ears having a concave portion on a forward edge, a single elastic cord having a stop member thereon; and each of said ears having a convex portion on a rearward edge which is opposite said forward edge, said concave portion functioning as a stop means to permit a limited length of said elastic cord to remain suspended by said ears, and said concave portions for said stop member.

* * * * *